United States Patent [19]

Kondo

[11] Patent Number: 4,629,054

[45] Date of Patent: Dec. 16, 1986

[54] APPARATUS FOR SUPPLYING SLIDE FASTENER SLIDERS

[75] Inventor: Naoki Kondo, Runcorn, England

[73] Assignee: Yoshida Kogyo K.K., Tokyo, Japan

[21] Appl. No.: 782,590

[22] Filed: Oct. 1, 1985

[30] Foreign Application Priority Data

Oct. 2, 1984 [JP] Japan ..... 59-149217[U]

[51] Int. Cl.[4] ..... B65G 47/24

[52] U.S. Cl. ..... 198/388; 198/391; 198/416; 193/46; 29/409; 29/768; 29/809

[58] Field of Search ..... 198/388, 389, 390, 391, 198/392, 416; 29/409, 768, 809; 193/25 FT, 44, 46, 48; 221/171, 172, 175

[56] References Cited

U.S. PATENT DOCUMENTS

| | | | |
|---|---|---|---|
| 2,949,666 | 8/1960 | Rogers et al. | 29/809 X |
| 3,116,544 | 1/1964 | Fisher | 29/768 |
| 3,421,924 | 1/1969 | Harlam et al. | 198/388 X |
| 3,956,812 | 5/1976 | Kawakami et al. | 29/768 |
| 4,337,877 | 7/1982 | Doori | 29/768 X |

FOREIGN PATENT DOCUMENTS 1782885 11/1979 Fed. Rep. of Germany ..... 29/768

*Primary Examiner*—Joseph E. Valenza
*Assistant Examiner*—Jonathan D. Holmes
*Attorney, Agent, or Firm*—Hill, Van Santen, Steadman & Simpson

[57] ABSTRACT

A slider supplying apparatus, for use with a slide-fastener finishing machine, includes a rail for slidingly supporting a number of sliders in succession from a reservoir, with the opposite wings of each slider body astride of the rail and with a pull tab hanging from the slider body, and a chute defining a guide channel for passage therethrough of the slider bodies and having an upper end portion disposed adjacent to a free end portion of the rail for receiving the successive sliders therefrom. The upper end portion of the chute has a sloping edge engageable with the pull tab of each slider, as the latter slides forwardly on the free end portion of the rail, so as to raise the pull tab perpendicularly to the slider wing. The chute also has a guide slit coextensive with the guide channel for receiving the pull tab of each slider in such raised posture while the slider body is in the guide channel.

7 Claims, 7 Drawing Figures

APPARATUS FOR SUPPLYING SLIDE FASTENER SLIDERS

BACKGROUND OF THE INVENTION

1. Field of the Invention

The present invention relates to the production of slide fasteners, and more particularly to an apparatus for supplying sliders successively to a slider-threading station where each slider is threaded onto a pair of slide fastener stringers.

2. Description of the Prior Art

U.S. Pat. No. 4,337,877 issued July 6, 1982 discloses an apparatus for supplying sliders successively to a slider-threading station, with one flanged side of each slider body facing upwardly and with a pull tab raised perpendicularly to the slider body. The prior art apparatus includes a vertical rail for slidingly supporting on its one longitudinal edge the sliders one over another, with one flanged side of each slider body facing upwardly and with the pull tab lying flat on the slider body, and a fluid-pressurized cylinder having a pushing rod for pushing the pull tab of each slider to a raised posture while the latter is at rest at the lower end of the vertical rail. This prior art apparatus is disadvantageous in that the fluid-pressurized cylinder must be operated in timed relation to the intermittent feeding of the successive sliders, which requires meticulous adjusting. Another disadvantage of the prior art apparatus is that since the feeding of the successive sliders must be halted repeatedly, continuous and smooth feeding of the sliders is difficult to achieve. Further, because of the fluid-pressurized cylinder, this known apparatus is complex in construction and hence expensive to manufacture.

SUMMARY OF THE INVENTION

According to the present invention, a slider supplying apparatus includes a rail for slidingly supporting a number of sliders in succession from a reservoir, with the opposite wings of each slider body astride of the rail and with a pull tab hanging from the slider body, and a chute defining a guide channel for passage therethrough of the successive slider bodies and having an upper end portion disposed adjacent to a free end portion of the rail for receiving the successive sliders therefrom. The upper end portion of the chute has a sloping edge engageable with the pull tab of each slider, as the latter slides forwardly on the free end portion of the rail, so as to raise the pull tab perpendicularly to the slider wing. The chute also has a guide slit coextensive with the guide channel for receiving the pull tab of each slider in such raised posture while the slider body is in the guide channel.

It is therefore an object of the present invention to provide an apparatus for supplying successive sliders to a slider-threading station continuously and smoothly in an orderly fashion, thus facilitating subsequent threading of the individual slider onto a pair of slide fastener stringers.

Another object of the invention is to provide a slider supplying apparatus which is simple in construction and hence inexpensive to manufacture.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
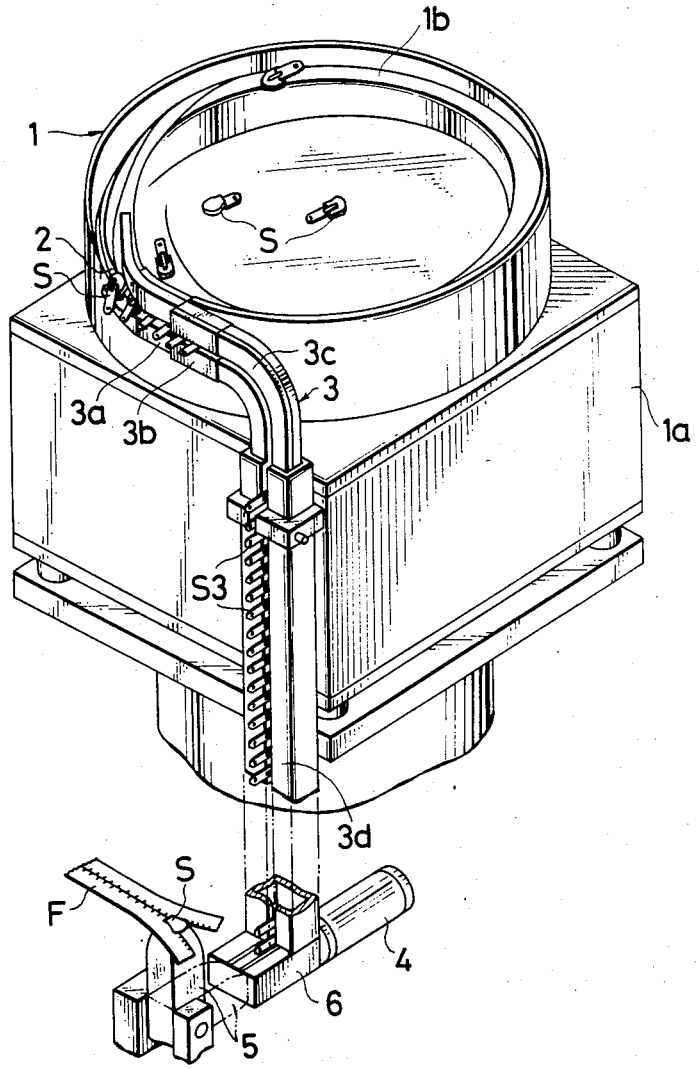
FIG. 1 is a fragmentary perspective view of a slider supplying apparatus embodying the present invention.

The present invention is particularly useful when embodied in a slider supplying apparatus such as shown in FIG. 1.

The apparatus generally comprises a vibratable bowl or reservoir 1 for storing a number of sliders S, a rail 2 extending substantially horizontally from the reservoir 1 for slidingly supporting the sliders S therefrom in succession, and a chute 3 for guiding the successive sliders S from the rail 2 to a terminal guide 6 disposed contiguously to a slider-threading station where the individual slider S is threaded onto a pair of slide fastener stringers F by means of a slider holder 5. As better shown in FIGS. 3–7, each slider S includes a slider body having a pair of parallel wings interconnected by a neck S2 so as to define therebetween a generally Y-shaped guide channel S1, and a pull tab S3 pivotally connected to one of the wings.

Figure 2:
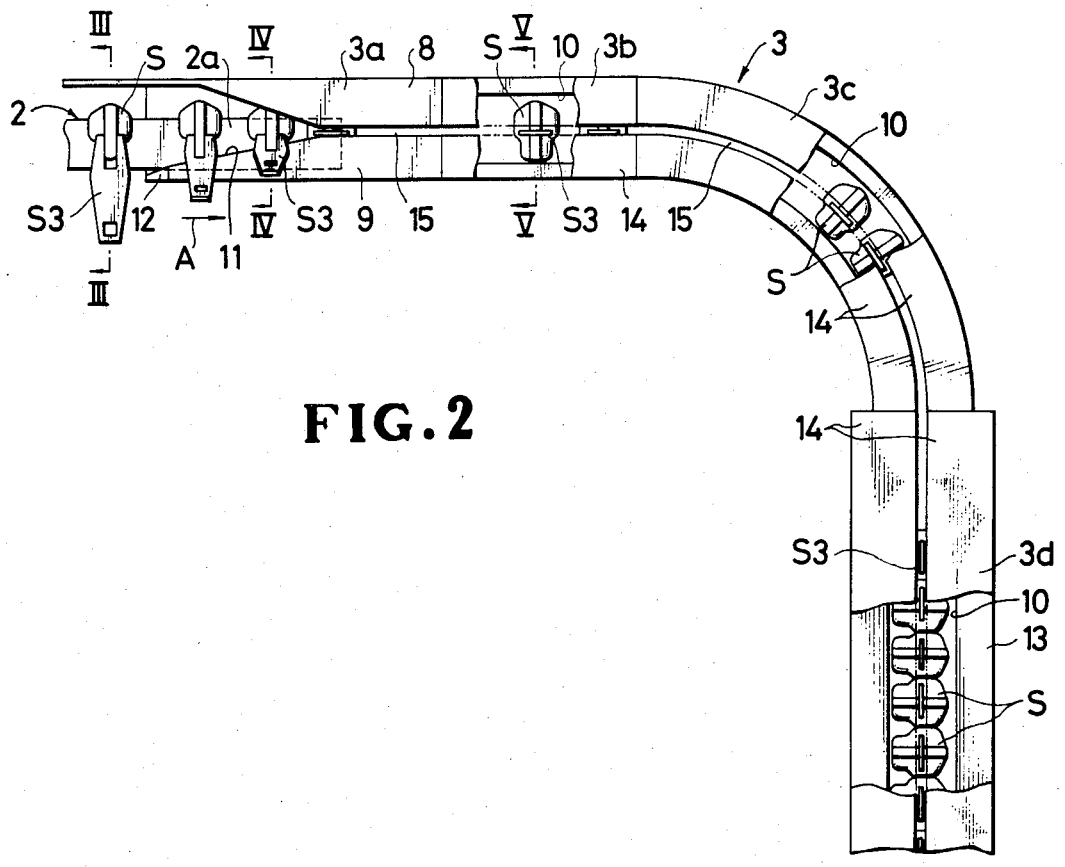
FIG. 2 is an enlarged front elevational view of a portion of the apparatus of FIG. 1.
Figure 3:
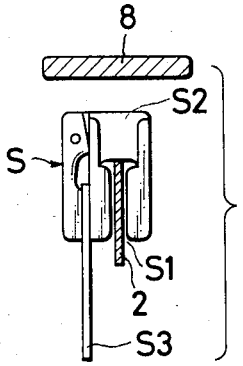
FIG. 3 is an enlarged cross-sectional view taken along line III—III of FIG. 2.

As shown in FIGS. 1 and 2, the chute 3 is of an inverted-L shape including a substantially horizontal upstream section **3*b*, a vertical downstream section 3*d* extending upwardly from the terminal guide 6, and an arcuate intermediate section 3*c* extending between the upstream and downstream sections 3*b*, 3*d*. The chute 3 also has, as an extension of the upstream section 3*b*, an upper end portion 3*a* disposed adjacent to a free end portion 2*a* of the rail 2 for receiving the successive sliders S therefrom in a manner described below. The chute 3 defines a guide channel 10 extending through the upper end portion 3*a*, the upstream section 3*b*, the intermediate section 3*c* and the downstream section 3*d* for passage therethrough of the slider bodies in a row. The chute 2 also defines a guide slit 15 opening to and coextending with the guide channel 10 for receiving a pull tab S3 of the individual slider S in a raised posture (described below) with respect to the slider body while the latter is in the guide channel 10**.

The width of the guide slit 15 is slightly larger than the thickness of the individual pull tab S3 so that the latter is prevented from turning about its own axis. As a consequence, while the individual slider S is guided in and along the chute 3, the slider body is prevented from turning or rolling with respect to the axis of the guide channel 10.

Figure 4:
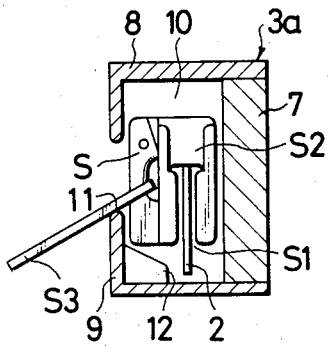
FIG. 4 is an enlarged cross-sectional view taken along line IV—IV of FIG. 2.

The upper ehd portion **3*a* of the chute 3, as better shown in FIG. 4, includes a side plate 7 and a pair of upper and lower flanged cover plates 8, 9. The lower flanged cover plate 9 has a sloping edge 11** which is engageable with the pull tab S2 of each slider S, as the latter slides forwardly (rightwardly in FIG. 2) on the free end portion 2*a* of the rail 2, so as to progressively raise the pull tab S2 from a vertical posture (FIG. 3) to a horizontal posture (FIG. 5) in which the pull tab S3 lies perpendicularly to the one wing of the slider body. A distal end 12 (FIGS. 2 and 4) of the lower flanged cover plate 9 is bent diagonally inwardly to assist the pull tab S3 in riding onto the sloping edge 11 at the beginning of this raising.

Figure 5:
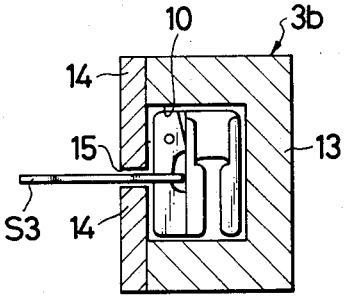
FIG. 5 is an enlarged cross-sectional view taken along line V—V of FIG. 2.

The upstream section 3*b* of the chute 3, as better shown in FIG. 5, includes a straight guide member 13 of generally C-shaped cross section and a pair of opposed side members 14, 14 coextending with the guide member 13 so as to cover the side opening thereof and spaced edgewise from each other so as to define therebetween a part of the guide slit 15. The construction of the intermediate section 3*c* is similar to that of the upstream section 3*b*, excepting that the guide member 13 and the side members 14, 14 are arcuate. The downstream section 3*d* is also similar to the upstream section 3*b*, excepting that the guide member 13 has an increased thickness, the individual side member 14 having an increased width.

In operation, as the reservoir 1 is vibrated by an electromagnetic vibrator 1*a* (FIG. 1) of a known construction, the sliders S in the reservoir 1 are moved on and along a spiral track 1*b* and are then transferred successively to the rail 2, which extends tangentially to the spiral track 1*b*. The rail 2 slidingly supports the successive sliders S front-side up, with the wings of each slider body astride of the rail 2 and with the pull tab S3 hanging from one of the wings, as better shown in FIG. 3. The sliders S slide in succession on the rail 2 toward the upper end portion 3*a* of the chute 3.

With continued sliding of the successive sliders S, the pull tab S3 of each slider S rides onto the sloping edge 11 of the lower flanged cover plate 9 of the upper end portion 3*a* of the chute 3 when each slider S arrives at the free end portion 2*a* of the rail 2. Then, as the individual slider S slides forwardly on the free end portion 2*a* of the rail 2, the pull tab S3 is progressively raised by the sloping edge 11 of the lower flanged cover plate 9, as shown in FIG. 4, until the pull tab S3 lies perpendicularly to the slider wing (FIG. 5).

Subsequently, the successive sliders S from the rail 2 travel by gravity through the chute 2 toward the terminal guide 6. During that time, the pull tab S3 of each slider S is received in the guide slit 15 so as not to turn about its own axis, thus preventing the slider body from turning or rolling with respect to the axis of the guide channel 10. In the upstream section 3*b* of the chute 3, the individual sliders S retain their posture of FIG. 5 in which the front-side of each slider S faces upwardly, while in the downstream section 3*d*, the successive sliders S are stacked one over another, with one flanged side of each slider S facing upwardly, as shown in FIGS. 1 and 2. Thus in any section of the chute 3, the pull tab S3 of each slider S retains its raised posture perpendicular to one slider wing.

Figure 7:
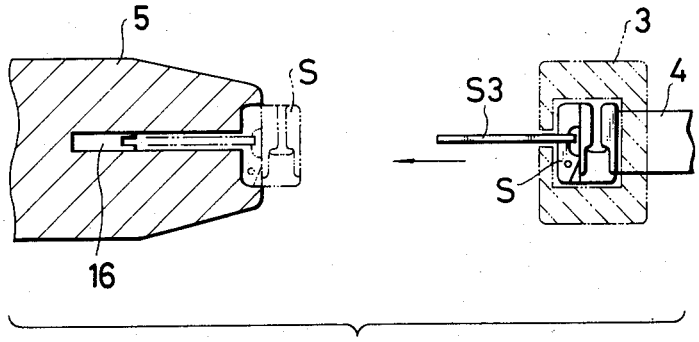
FIG. 7 illustrates the manner in which a slider is transferred from a chute of the apparatus to a slider holder.

Finally, at the terminal guide 6, the successive sliders S are delivered one at a time to the slider holder 5 by pushing by a pushing rod (not shown) of a fluid-pressurized cylinder 4 until the pull tab S3 is fully inserted in a retaining slot 16 in the slider holder 5, as shown in FIG. 7. The slider holder 5 assumes at this time a horizontal position (phantom lines in FIG. 1) to receive the individual slider S and is then pivotally moved to a vertical position (solid lines in FIG. 1) in which a pair of slide fastener stringers F is threaded through the Y-shaped guide channel of the slider S placed on the slider holder 5.

With this arrangement, since raising of the pull tabs S3 of the successive sliders S takes place as the pull tabs S3 simply slide over the sloping edge 11, it is not necessary to halt the feeding of the successive sliders S during the raising of the individual slider's pull tab S3. As a consequence, it is possible to supply the successive sliders S to the slider-threading station continuously and smoothly in an orderly fashion, thus causing an improved rate of production of the slide fasteners. Further, since the pull-tab raising takes place without using a separate pusher mechanism such as a fluid-pressurized cylinder, the apparatus is simple in construction and hence inexpensive to manufacture.

In the illustrated embodiment, the chute 3 is composed of the four separate sections 3*a*, 3*b*, 3*c*, 3*d* connected end to end. Alternatively, at least the upper end portion 3*a* and the upstream section 3*b* are integral with each other.

Figure 6:
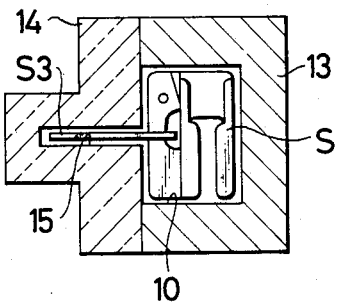
FIG. 6 is a cross-sectional view similar to FIG. 5, but showing a modification of the apparatus.

The side plates 14, 14 may be made preferably of transparent synthetic resin so that the operator can observe it at a single glance if there is any jamming of the sliders S in the chute 3 due to any foreign matter such as dust. Further, the transparent side plates 14, 14 may be integral with each other to facilicate guiding of the pull tab S3, as shown in FIG. 6.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for supplying slide fastener sliders successively to a slider-threading station in a slide-fastener finishing machine, each of the sliders including a slider body having a pair of parallel wings, and a pull tab pivotally connected to one of the wings, said apparatus comprising:

(a) a reservoir adapted to be disposed above the slider-threading station for storing a number of sliders;

(b) a terminal guide adapted to be disposed contiguously to the slider-threading station for receiving the sliders one at a time for delivery to the slider-threading station;

(c) a rail extending from said reservoir for slidingly supporting the sliders therefrom in succession, with the wings of each slider body astride of said rail and also with the respective pull tab hanging from the slider body;

(d) a chute extending upwardly from said terminal guide and terminating in an upper end portion disposed adjacent to a free end portion of said rail for receiving the successive sliders therefrom, said upper end portion of said chute having a sloping edge engageable with the pull tab of each slider, as the latter slides forwardly on said free end portion of said rail, so as to progressively raise the pull tab until the latter lies perpendicularly to said one wing of each slider body, said chute having through its entire length a guide channel for passage therethrough of the slider bodies in succession, and a guide slit opening to and coextending with said guide channel for receiving the pull tab of each slider in such raised posture while the corresponding slider body is in said guide channel.

2. An apparatus according to claim 1, said chute having a substantially horizontal upstream section disposed contiguously to said upper end portion, a vertical downstream section extending upwardly from said terminal guide, and an arcuate intermediate section extending between said upstream and downstream sections.

3. An apparatus according to claim 2, said upper end portion being integral with said upstream section.

4. An apparatus according to claim 1, said rail extending substantially horizontally into said upper end portion of said chute.

5. An apparatus according to claim 1, said chute including a guide member of generally C-shaped cross section, and a pair of opposed side members coextending with said guide member so as to cover such an opening thereof and spaced edgewise from each other.

6. An apparatus according to claim 5, said side members comprising transparant synthetic resin.

7. An apparatus according to claim 1, said upper end portion of said chute including a side plate and a pair of upper and lower flanged cover plates, a flange of said lower flanged cover plate being tapered and having a diagonally inwardly directed distal end.

* * * * *